US006886623B2

(12) United States Patent
Kato et al.

(10) Patent No.: US 6,886,623 B2
(45) Date of Patent: May 3, 2005

(54) STRIP CASTING APPARATUS

(75) Inventors: Heiji Kato, Yokosuka (JP); John Andrew Fish, Brownsburg, IN (US); Wayne Russell, Figtree (AU)

(73) Assignee: Castrip LLC, Charlotte, NC (US)

( * ) Notice: Subject to any disclaimer, the term of this patent is extended or adjusted under 35 U.S.C. 154(b) by 0 days.

(21) Appl. No.: 10/040,092

(22) Filed: Oct. 19, 2001

(65) Prior Publication Data

US 2002/0088602 A1 Jul. 11, 2002

Related U.S. Application Data

(63) Continuation-in-part of application No. 09/324,000, filed on Jun. 2, 1999, now abandoned.

(30) Foreign Application Priority Data

Jun. 17, 1998 (AU) ..... PP4143

(51) Int. Cl.[7] ..... B22D 11/06; B21B 45/02

(52) U.S. Cl. ..... 164/480; 164/158; 164/428; 15/256.52

(58) Field of Search ..... 164/428, 480, 164/429, 479, 158; 15/256.51, 256.52, 256.53

(56) References Cited

U.S. PATENT DOCUMENTS 3,795,025 A * 3/1974 Sadamitsu ..... 15/256.52
4,530,597 A * 7/1985 Itaya et al. ..... 399/353
4,793,400 A * 12/1988 Wood ..... 164/121
5,964,277 A 10/1999 Tanaka et al.

FOREIGN PATENT DOCUMENTS

JP 9-29394 * 2/1997

* cited by examiner

*Primary Examiner*—Kuang Y. Lin
(74) *Attorney, Agent, or Firm*—Barnes & Thornburg LLP

(57) ABSTRACT

An apparatus for casting metal strip in which molten metal is applied to a casting roll the surface of which is cleaned by a cleaning brush device comprising a main brush extending across the roll surface by sweeper brush actuator 28A and a sweeper brush extending across the roll and capable of tangentially engaging the peripheral longitudinal roll surface in advance of the main brushing device. Both brushes are mounted on mounting frames moveable to bring the main and sweeper brushes into contact with the casting roll. The sweeper brush is independently moveable on the frame by operation of an sweeper brush actuator to move the sweeper brush into engagement with the surface of the casting roll near the start and end of the casting run and the main brush actuator to move the main brush into engagement with the peripheral longitudinal surface of the casting roll during normal casting operation.

19 Claims, 3 Drawing Sheets

STRIP CASTING APPARATUS

CROSS-REFERENCE TO RELATED APPLICATIONS

This is a continuation-in-part of U.S. utility patent application Ser. No. 09/324,000, filed Jun. 2, 1999 now abandoned, which claims the benefit of Australian provisional patent application No. PP 4143, filed Jun. 17, 1998.

BACKGROUND OF THE INVENTION

This invention relates to a metal strip casting apparatus in which molten metal is brought into contact with a casting roll surface so as to solidify on that surface. More specifically, it is concerned with cleaning of the casting rolls in such casters.

The casting apparatus may be either a single roll caster or a twin roll caster. In a twin roll caster hot metal is introduced between a pair of contra-rotated horizontal casting rolls which are cooled so that metal shells solidify on the moving roll surfaces and are brought together at the nip between them to produce a solidified strip product at the outlet from the roll nip. The term "nip" is used herein to refer to the general region at which the rolls are closest together. The hot metal may be introduced into the nip between the rolls via a metal delivery nozzle located above the nip to form a casting pool supported on the casting roll surfaces immediately above the nip and confined at the ends of the nip by appropriate confining means such as pool side damming plates.

In order to prevent accumulation of metal oxides and slags or other contaminants on the roll surfaces, cleaning devices such as brushes or cleaning belts may be applied to the outer longitudinal surfaces of the rolls so that the roll surfaces are continuously cleaned before moving into contact with the molten metal in advance of the nip. One apparatus of this kind is disclosed in Japanese Patent Publication JO3230849-A of Nippon Steel Corporation and Mitsubishi Heavy Industries KK. In this apparatus two sets of divided roller brushes are applied to the peripheral surface of each chilled casting roll with the brushes of one set being staggered with respect to those of the other set to provide a brushing action across the complete width of the casting roll. Japanese Patent Publication J01-083341-A also of Nippon Steel Corporation and Mitsubishi Heavy Industries KK also discloses a twin roll caster in which the casting rolls are cleaned by brushes. Japanese Patent Application 29393/97 and 29394/97 of Nippon Steel Corporation disclose roll cleaning arrangements in which two cylindrical cleaning brushes are brought successively into contact with a casting roll at different stages of a casting run. U.S. Pat. No. 4,793,400 discloses a casting drum cleaner in which a pair of similar rotating brushes are applied in tandem to the drum, both brushes being driven in opposite directions to the rotation of the drum. Other roll brushing arrangements are disclosed in our U.S. Pat. Nos. 5,307,861 and 5,575,327.

It has been found that during the start and finish of a casting operation, the casting roll picks up major accretions of contaminants and these can damage the brushing device which must be capable of performing fine cleaning of the casting surface during normal casting. The contaminants can also damage the casting roll surface if they accumulate between the casting rolls and the metal delivery support plate. The present invention provides a brushing device by which a rotary sweeper brush can be brought into engagement with the casting roll surface in advance of a main brush to sweep off such major accretions at least during the start and finish of a casting run.

SUMMARY OF THE INVENTION

There is provided an apparatus for casting metal strip, comprising at least one casting roll, a metal delivery system to deliver molten metal onto the surface of the casting roll and a roll brushing apparatus to clean the roll surface, the brushing apparatus comprising:

at least one brush mounting frame;

a main brush mounted on one said mounting frame to extend across the roll and capable of tangentially engaging the peripheral longitudinal roll surface and capable of fine cleaning the casting rolls during the normal casting operation;

an elongate rotary sweeper brush mounted on one said mounting frame to extend across the roll and capable of tangentially engaging the peripheral longitudinal roll surface in advance of the main brush capable of sweeping off major accretions which occur near the start and end of a casting run;

a sweeper brush actuator on the mounting frame to move the sweeper brush into engagement with the casting roll at the beginning and end of the casting run, and a main brush actuator on the mounting frame to move the main brush into engagement with the casting roll surface at least during normal casting operation.

The sweeper brush may be a barrel brush rotatably mounted on a brush mounting structure connected to the brush actuator. The sweeper brush may be mounted independently of the main brush on a separate mounting frame or alternatively may be mounted with the main brush on the same mounting frame. In one embodiment, the sweeper brush may be mounted on the same mounting frame as the main frame but able to move independently of the main brush into and out of engagement with the casting roll. In any event, the main brush and sweeper brush may be positively driven either together or independently of each other. The main brush may be embodied to rotate in either direction relative to the rotation of the casting roll, but usually is embodied to rotate in the same rotational direction of the casting roll. The sweeper brush rotates in the same direction as the casting rolls at a speed higher or lower than the rotational speed of the casting rolls. By rotating in the same direction as the casting rolls, the sweeper brush and main brush are likely to be more effective in cleaning the roll surfaces without scoring the roll surfaces by dragging accretions over the roll surface since the brushes are moving counter to the roll surface at the area of tangential contact with the roll surface.

The sweeper brush actuator may comprise a fluid cylinder device, and is generally actuated to move the sweeper brush into engagement with the casting roll near the start and end of the casting run, and out of engagement from the casting roll during production casting operation. The main brush actuator moves the main brush into engagement with the casting rolls at least during normal casting operations. The sweeper brush actuator and main brush actuator should move the sweeper brush and main brush such that there is no interruption in sweeping the casting rolls caused by movement of the sweeper brush and the main brush into and out of engagement with the casting rolls. The sweeper brush and main brush actuators provide such engagement of the main brush and sweeper brush with the casting roll surface so that the sweeper and main brushes are efficient in brushing the surface of the casting roll without causing undue scoring or wear to the surface of the casting roll.

The apparatus may further comprise an elongate scraper mounted on one of the brush mounting structures to move in and out with the sweeper brush and to engage the sweeper brush so as to scrape swept material from it.

BRIEF DESCRIPTION OF DRAWINGS

In order that the invention may be more fully explained, particular embodiments will be described in detail with reference to the accompanying drawings in which.

DESCRIPTION OF PARTICULAR EMBODIMENTS

Figure 1:
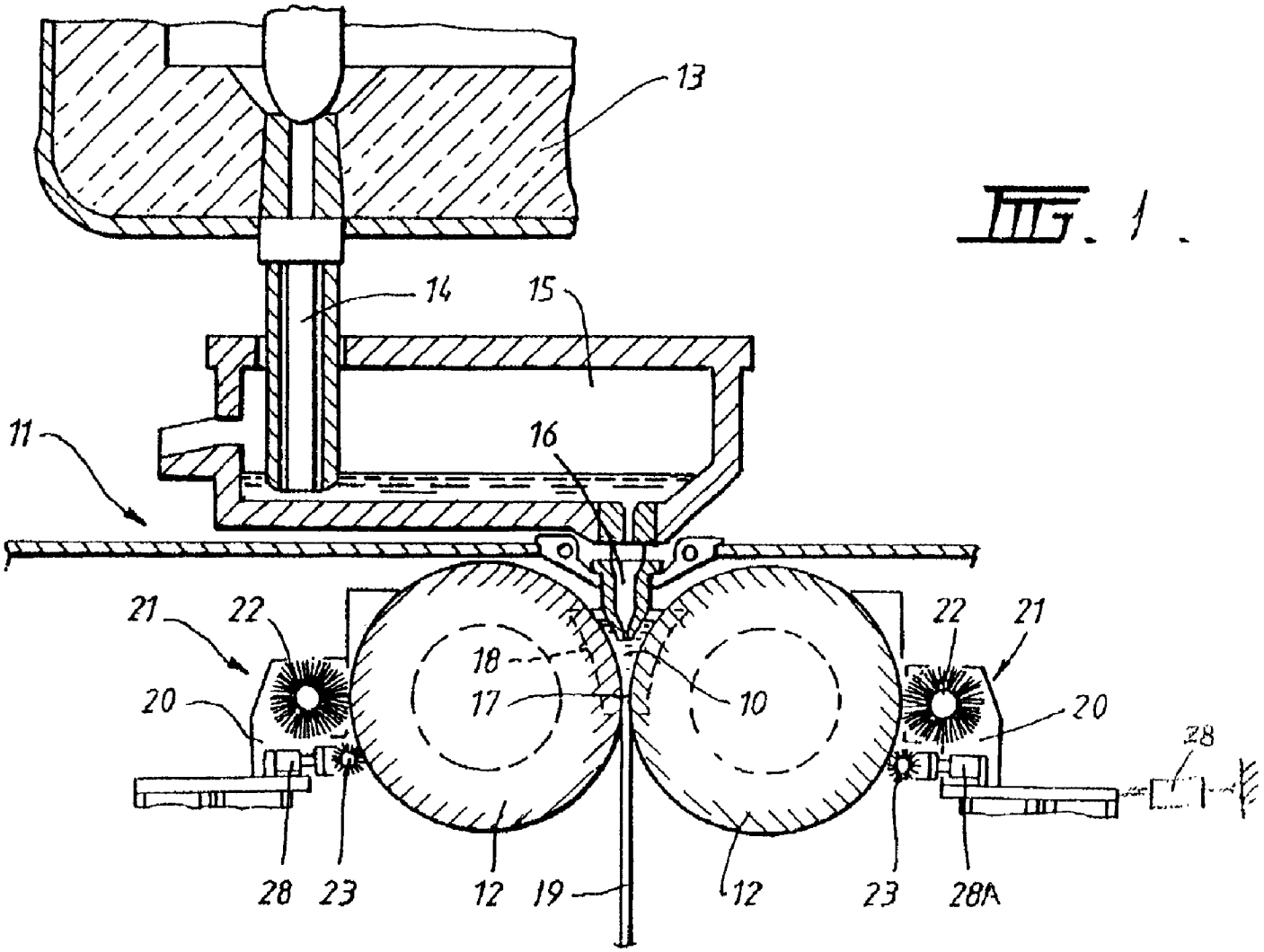
FIG. 1 illustrates a twin roll caster incorporating a pair of brushing apparatus in accordance with the invention.

The embodiments are described with reference to a twin roll caster, but they are not limited to use with twin roll casters. The illustrated twin roll caster comprises a main machine frame 11 which supports a pair of parallel casting rolls 12 of generally textured outer peripheral longitudinal surfaces. Molten metal is supplied during a casting operation from a ladle 13 through a refractory ladle outlet shroud 14 to a tundish 15 and thence through a metal delivery nozzle 16 into the nip 17 between the casting rolls 12. Hot metal thus delivered to the nip 17 forms a pool 10 above the nip and this pool is confined at the ends of the rolls by a pair of side closure or side dam plates 18 which are held against stepped ends of the rolls by actuation of a pair of hydraulic cylinder units (not shown). The upper surface of the pool 10 (generally referred to as the "meniscus" level) may rise above the lower end of the delivery nozzle so that the lower end of the delivery nozzle is immersed within this pool.

Casting rolls 12 are water cooled so that shells solidify on the moving roller surfaces and are brought together at the nip 17 between them to produce a solidified strip product 19 at the roll outlet. This product may be fed, typically with further processing, to a standard coiler (not shown).

The illustrated twin roll caster as thus far described is of the kind which is illustrated and described in some detail in our Australian Patent 631728 and our U.S. Pat. No. 5,184,668 and reference may be made to those patents for appropriate constructional details which form no part of the present invention.

A pair of roll brushing apparatus denoted generally as 21 is disposed on to each side of the pair of casting rolls such that they can be engaged with the outer peripheral surfaces of the rolls 12 at opposite sides of nip 17 prior to the peripheral surfaces of the casting rolls entering the molten metal delivery system.

Each brushing apparatus 21 comprises a brush frame 20 which carries a main casting roll cleaning brush 22 and a separate sweeper brush 23. Frame 20 comprises a base plate 41 and upstanding side plates 42 on which the main cleaning brush 22 is mounted. Base plate 41 is fitted with slides 43 which are slidable along a track member 44 to allow the frame 20 to be moved toward and away from one of the casting rolls 12 and thereby move the main brush 22 mounted on the frame 20 by operation of the main brush actuator 28. The sweeper brush 23 is mounted on frame 20 to move independently of the main brush 22 by operation of sweeper brush actuator 28A from retracted positions to operative positions in contact with the casting roll, so that either the sweeper brush 23 or the main brush 22, or both, is brushing the casting rolls without interruption in the brushing operation between them.

The main brush 22 is in the form of a cylindrical barrel brush having a central body 45 carried on a shaft 34 and fitted with a cylindrical canopy of wire bristles 46. Shaft 34 is rotatably mounted in bearings 47 in the side plates 42 of frame 20 and a pneumatic drive motor mounted on one of these side plates is coupled to the brush shaft 34 so as to rotatably drive the brush in the same direction as the rotation of the casting roll, as indicated by the arrow 36 in FIG. 2. Although the main brush is shown as a cylindrical barrel brush but it should be understood that this brush may take other forms such as the elongate rectangular brush disclosed in U.S. Pat. No. 3,078,61, the rotary brushing devices disclosed in U.S. Pat. No. 5,575,327 or the pivoting brushes of Australian Patent Application PO7602. The precise form of the main brush is not critical to the present invention.

The separate sweeper brush 23 is in a form of a cylindrical barrel brush which is mounted on frame 20 so as to be moveable on the frame such that it can be brought into engagement with the casting roll 12 or retracted away from that roll by operation of the sweeper brush actuator 28A independent of whether the main brush is engaged with the casting roll. This enables the sweeper brush 23 to be moved independently of the main brush 22 and brought into operation only during the start and finish of a casting run and be withdrawn during normal casting as described below. The sweeper brush 23 is rotatably driven in tandem with or independently of the main brush 22. The sweeper brush 23 is driven in the same direction as the casting rolls at a speed different from the speed of the casting rolls. In this way, the large accretions that can occur at the start and end of the casting run are less likely to be dragged across the roll surface and cause scoring of the casting roll surface since the sweeper brush is contacting the casting roll surface moving in the direction counter to movement of the casting roll surface. Although the main brush may be driven in a direction counter to the rotation of the casting roll, the main brush is usually driven in the same rotational direction as the casting rolls.

Sweeper brush 23 has a central body 24 carried on a shaft 25 and fitted with a cylindrical canopy of wire bristles 26. The barrel brush shaft 25 is rotatably mounted in a brush mounting structure 27 which can be moved back and forth by operation of quick acting hydraulic cylinders 28 to move the barrel brush inwardly against the casting roll 12 or to retract it away from the casting roll. The roll mounting structure 27 may be in the form of a wide yoke with side wings 30 in which the brush shaft 25 is rotatably mounted in bearings 31. The barrel brush 23, brush mounting structure 27 and actuator 28 are carried on the main frame 20 of the brushing apparatus 21 so that the sweeper brush will always be correctly positioned in advance of he main brush 22. The roll mounting structure 27 may carry an elongate scraper blade 29 which extends throughout the width of the barrel brush 23 and projects into the canopy of bristles 26. Blade 29 may be made of hardened steel and have a sharp leading edge.

Figure 4:
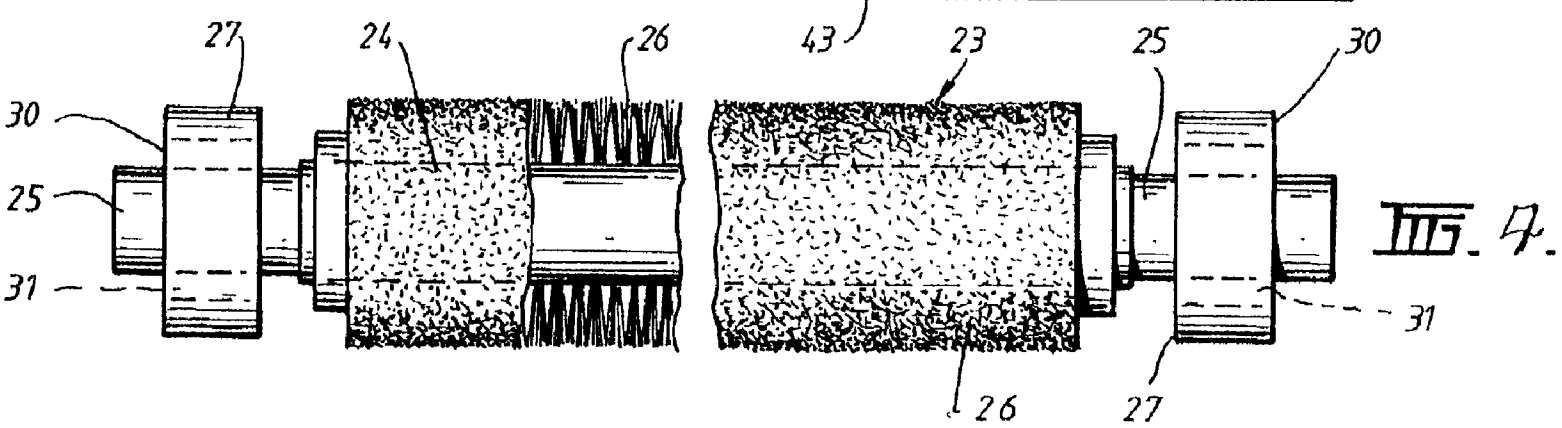
FIG. 4 is a front elevation of a sweeper brush of the brushing apparatus.
Figure 3:
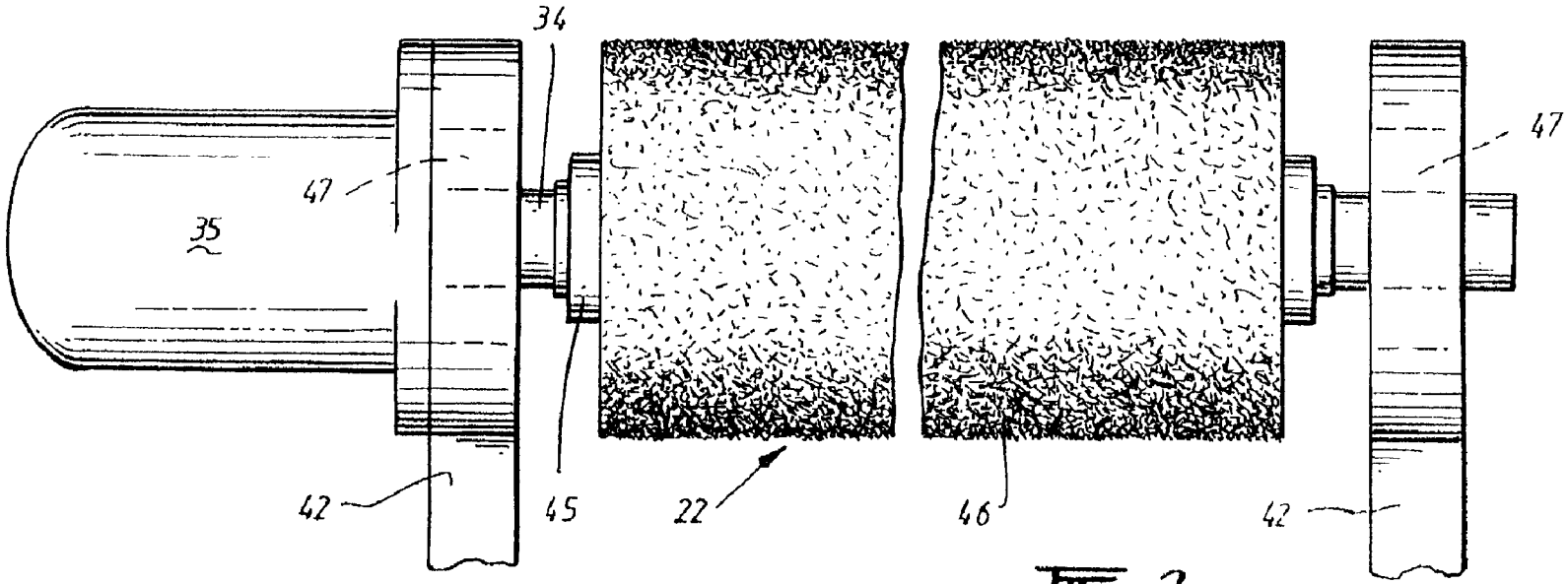
FIG. 3 is a front elevation of a main brush of the brushing apparatus.

Sweeper brush 23 may be rotated purely by frictional engagement between its canopy of bristles 26 with the casting roll 12 in which case it may be simply rotatably mounted between the side plates 42 of frame 20 without any drive means as shown in FIG. 4. In preferred embodiments the sweeper brush 23 is positively driven by provision of a pneumatic drive motor 48 as shown in FIG. 5.

Figure 2:
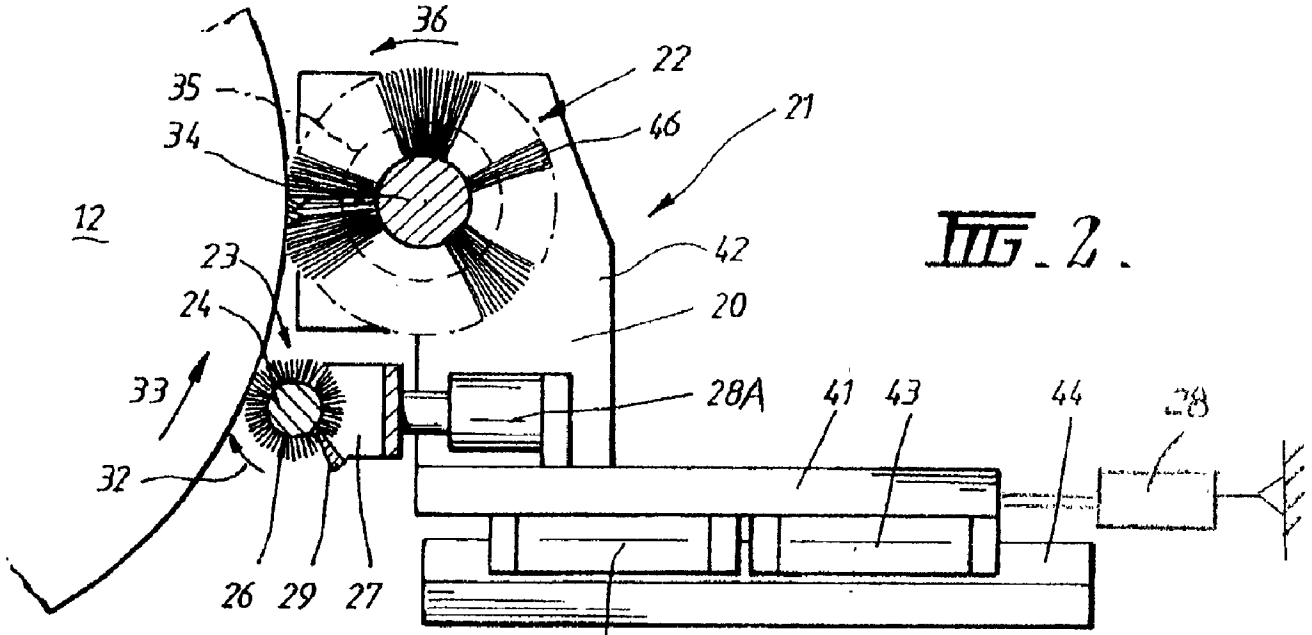
FIG. 2 illustrates one of the brushing apparatus.

With the arrangement shown in FIG. 4, sweeper brush 23 is biased inwardly against the casting roll 12 by actuation of the cylinder units 28 such that it is rotatably driven by the frictional engagement between the canopy of bristles 26 and the roll surface so that it is rotated in the opposite rototional (same peripheral) direction at the roll surface at the region of its engagement with the roll surface, as indicated by the arrows 32, 33 in FIG. 2. The rotation of the sweeper brush 23 is retarded by its inter-engagement with the scraper blade 29 so that the sweeper brush 23 is driven at a slower peripheral speed than the casting roll. The relative speed between the roll and the barrel brush 23 causes effective sweeping action and ensures that the bristles engaging the casting roll will change continuously. The scraper blade 29 also effectively cleans the sweeper brush 23 of contaminating material swept from the casting surface of the roll so that clean bristles are continuously presented to the casting roll surface.

Figure 5:
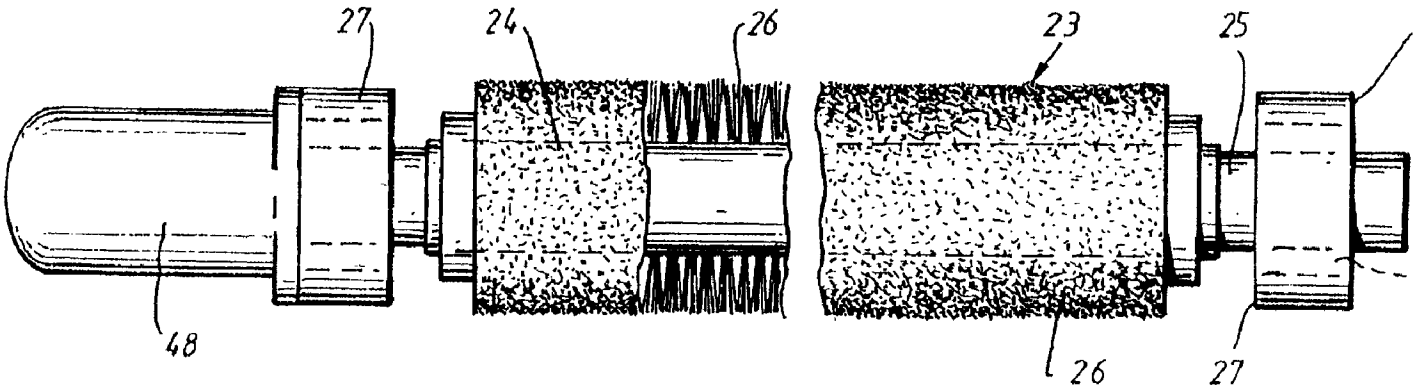
FIG. 5 is a front elevation of the sweeper brush in a modified apparatus in which the sweeper brush is positively driven by a drive motor.

In the preferred embodiments a sweeper brush drive motor 48 is provided as shown in FIG. 5, sweeper brush 23 can be positively driven at a fixed speed independent of the speed of the casting roll 12. It will generally be driven so that its bristles travel in the same rotational direction as the surface of the roll 12 but at a different (higher or lower) speed. The rotational speed of the brush can be varied to optimize this speed differential.

Sweeper brush 23 is moved into engagement with the casting roll prior to the start of casting and is moved away from the roll after casting conditions have stabilized. It is moved back into engagement with the roll just prior to termination of the cast. The point at which the casting conditions stabilize, and sweeper brush disengaged from the casting roll, is usually about when the setpoint is reached for the level of the pool 10 of molten metal, and the point at which the sweeper brush reengage is usually about when the setpoint level of the pool 10 is about to drop as the end of the casting run approaches. The sweeper brush serves to prevent damage to the main brush and the casting roll due to carry over of debris generated on commencement and near termination of the casting run.

Although the invention has been illustrated and described in detail in the foregoing drawings and description with reference to several embodiments, it should be understood that the description is illustrative and not restrictive in character, and that the invention is not limited to the disclosed embodiments. Rather, the present invention covers all variations, modifications and equivalent structures that come within the scope and spirit of the invention. Additional features of the invention will become apparent to those skilled in the art upon consideration of the detailed description, which exemplifies the best mode of carrying out the invention as presently perceived. Many modifications may be made to the present invention as described above without departing from the spirit and scope of the invention.

What is claimed is:

1. A method for casting metal strip using a casting roll, a metal delivery system to deliver molten metal onto the casting surface of the casting roll and a roll brushing apparatus to clean the casting roll surface, the method comprising the steps of:

rotating a main brush mounted to extend across the casting surface of the casting roll to tangentially engage-the peripheral longitudinal casting roll surface of the casting roll;

rotating an elongate rotary sweeper brush mounted to extend across the casting surface of the casting roll to tangentially engage the casting roll surface of the casting roll in advance of the position of the main brush relative to the casting surface of the casting roll;

driving the rotation of the sweeper brush in a direction opposite to the surface movement of the casting roll;

moving the sweeper brush independently of the main brush into engagement with the casting roll surface of the casting roll near the beginning and end of each casting run and to disengage from the casting roll during normal casting operation; and moving-the main brush into engagement with the casting roll surface at least during normal casting operation.

2. A method as claimed in claim 1, wherein a sweeper brush is rotatably mounted on a brush mounting structure connected to a sweeper brush actuator.

3. A method as claimed in claim 2, wherein the sweeper brush actuator and the main brush actuator comprise fluid actuable cylinder devices.

4. A method as claimed in claim 2, further comprising an elongate scraper mounted on a brush mounting structure to move with the sweeper brush and engaging the sweeper brush so as to scrape swept material from the sweeper brush.

5. A method as claimed in claim 4, wherein the sweeper brush comprises a central brush body and a plurality of bristles projecting radially outwardly from the central body and forming collectively a substantially cylindrical shape and the scraper comprises an elongate scraper blade projecting into the bristles of the brush.

6. A method as claimed in claim 5, wherein the bristles are formed of steel wire.

7. A method as claimed in claim 6, wherein the scraper blade is made of hardened steel.

8. A method as claimed in claim 1, wherein the main brush is an elongate rotary brush and the main brush mounting frame carries main brush drive operable to rotate the main brush.

9. A method as claimed in claim 1, further comprising a main brush drive operable to rotate the sweeper brush in a direction opposite to the movement of the casting surface of the casting roll.

10. A method as claimed in claim 1, wherein the sweeper brush is rotatably mounted on a sweeper brush mounting frame connected to the brush actuator and the sweeper brush drive is mounted on the brush mounting frame to move with the sweeper brush.

11. A method as claimed in claim 1, wherein the main brush mounting frame is moveable toward and away from the roll surface to move both the main brush and the sweeper brush between retracted and operative positions.

12. A method of casting metal strip using a casting roll metal delivery system to deliver molten metal onto the surface of the casting roll and roll cleaning brush apparatus to clean the casting roll surface, the method comprising the steps of: (i) rotating a main brushing device extending across the roll capable of tangentially engaging the peripheral longitudinal roll surface, (ii) rotating a second sweeper brushing device extending across the roll to engage the roll in advance of the main brushing device, the sweeper brushing device comprises an elongate rotatably driven barrel brush extending across the roll surface of the casting roll, (iii) engaging the roll in advance of the position of engagement of the main brushing device wit the second sweeper brushing device independent of the engagement of the main brushing device with the casting roll, (iv) driving the sweeper brush to rotate in a direction opposite to the surface movement of the casting roll, (v) rotating the main brushing device mounted on a mounting frame about its longitudinal axis to engage with the casting roll at least during production of a casting run, (vi) moving the main brush into engagement with the casting roll during production of the casting run, and (vii) separately moving the sweeper brush toward the casting roll at the start and end of the casting run and away from the casting roll during the production part of the casting run.

13. A method as claimed in claim 12, wherein a main brush actuator and a sweeper brush actuators are provided comprising fluid actuable cylinder devices.

14. A method as claimed in claim 12, further comprising an elongate scraper extending along the barrel brush and engaging the barrel brush so as to scrape swept material from the barrel brush.

15. A method as claimed in claim 14, wherein the scraper is fixed to a mounting frame for the sweeper brush.

16. A method as claimed in claim 12, wherein the sweeper brush comprises a central brush body and a plurality of bristles projecting radially outwardly from the central body and forming collectively a substitute cylindrical shape.

17. A method as claimed in claim 16, wherein the bristles are formed of steel wire.

18. A method as claimed in claim 16, wherein the scraper comprises an elongate scraper blade projecting into the bristle canopy of the barrel brush.

19. A method as claimed in claim 18, wherein the scraper blade has a sharp leading edge.

* * * * *